United States Patent [19]

Taylor

[11] 4,097,022

[45] Jun. 27, 1978

[54] WHEEL JACK APPARATUS

[76] Inventor: Robert E. Taylor, 309 SW. 11th St., Andrews, Tex. 79714

[21] Appl. No.: 818,825

[22] Filed: Jul. 25, 1977

[51] Int. Cl.[2] ..... B66F 13/00

[52] U.S. Cl. ..... 254/133 R

[58] Field of Search ..... 254/133, 134, 2 R, 2 B, 254/2 C; 214/330

[56] References Cited

U.S. PATENT DOCUMENTS

| | | | |
|---|---|---|---|
| 2,063,060 | 12/1936 | Sheetz | 254/133 R |
| 2,558,535 | 6/1951 | Billings | 254/134 |
| 2,777,527 | 1/1957 | Kleem | 254/134 |
| 3,313,523 | 4/1967 | Reynolds | 254/133 R |

*Primary Examiner*—Robert C. Watson
*Attorney, Agent, or Firm*—Marcus L. Bates

[57] ABSTRACT

A wheel jack apparatus having a vertical column which slidably receives a lifting head thereon so that the head can be forced to move respective to the column by means of a rack and pall located therebetween. A wheel adaptor is affixed to the lift apparatus and includes an upper sharp edge portion spaced from a lower fastener means. The sharp edge portion engages a concavity formed by the wheel rim while the fastener means is inserted through a slot formed between radially spaced lands on the wheel thereby enabling the wheel jack apparatus to positively engage the wheel of a vehicle and lift the wheel off the ground.

9 Claims, 11 Drawing Figures

WHEEL JACK APPARATUS

BACKGROUND OF THE INVENTION

This invention relates to vehicle wheel jacks which raises a wheel from a supporting surface so that the wheel can be removed and another substituted therefor.

People continue to be injured while attempting to change tires and wheels on a vehicle. This is because a bumper jack is usually employed to lift the vehicle, and for one reason or another, the bumper jack often fails to securely hold the vehicle in an elevated position while the wheel is being changed.

A bumper jack must lift the vehicle extremely high into the air in order that the tire, along with the wheel, may be removed. The vehicle body must be lifted a sufficient amount to compensate for the extension of the springs as well as lifting the wheel and flat tire from the supporting road surface.

Automobile designs change drastically year by year; and accordingly, the different bumper styles and designs require various different configurations of coacting bumper jacks. Furthermore, bumpers and the attachment members therefor lack the required structural integrity for supporting the weight of one side of most vehicles therefrom. Moreover, the extreme elevation required of the vehicle body presents an enormous amount of potential energy, and when the vehicle falls it often results in a fatality.

Accordingly, it is desirable to be able to engage the wheel of the vehicle and positively lift the wheel from its supporting surface an amount which is sufficient to enable the removal of the wheel and tire therefrom and substitute an inflated tire and wheel therefor. It is desirable that this expedient be carried out with a minimum of effort, at a reasonable cost, and in a manner which enhances safety.

Some pertinent prior art references are:

| | |
|---|---|
| Mizer | 2,239,729 |
| Roth | 2,553,281 |
| Marshall, Jr. | 3,300,183 |
| Reynolds | 3,313,523 |
| Migliano | 3,990,592 |

The above cited prior art fails to disclose the wheel jack apparatus of the present invention.

SUMMARY OF THE INVENTION

This invention relates to automotive type jacks, and specifically to a wheel jack for engaging and lifting the wheel along with one side of a vehicle attached thereto. The wheel jack includes a vertical column having means thereon which cooperates with a lifting mechanism so that the lifting mechanism can be caused to climb the column.

A wheel lift adaptor includes means by which it is affixed to said lift mechanism. The adaptor includes an upper end and a lower end each spaced forwardly and above and below the location where the adaptor is attached to the lift mechanism.

The upper end of the adaptor terminates in an edge portion which engages the circumferentially extending concavity formed by the annular bead receiving portion of the wheel. The marginal lower end of the adaptor has a fastener means formed thereon which extends through the slots formed by the lands of the wheel so that the fastener extends through the lands and engages wheel structure located opposite to the jack.

Accordingly, the primary object of the present invention is the provision of improvements in wheel jack apparatus by which a vehicle wheel can be lifted from its supporting surface.

Another object of the present invention is the provision of a wheel lift adaptor which can be affixed to a bumper type jack mechanism to enable the wheel of a vehicle to be lifted from a supporting surface and another wheel and tire subsequently substituted therefor.

The above objects are attained in accordance with the present invention by the provision of a combination of elements which are fabricated in a manner substantially as described in the above abstract and summary.

These and various other objects and advantages of the invention will become readily apparent to those skilled in the art upon reading the following detailed description and claims and by referring to the accompanying drawings.

Figure 1:
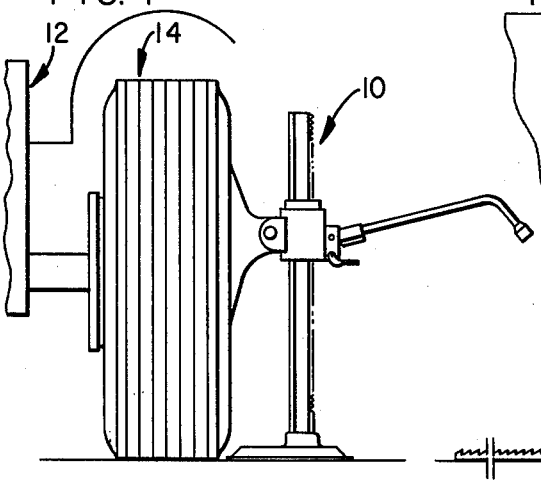
FIGS. 1–3 are fragmented, front elevational views which illustrate the use of the present invention in conjunction with a vehicle.
Figure 2:
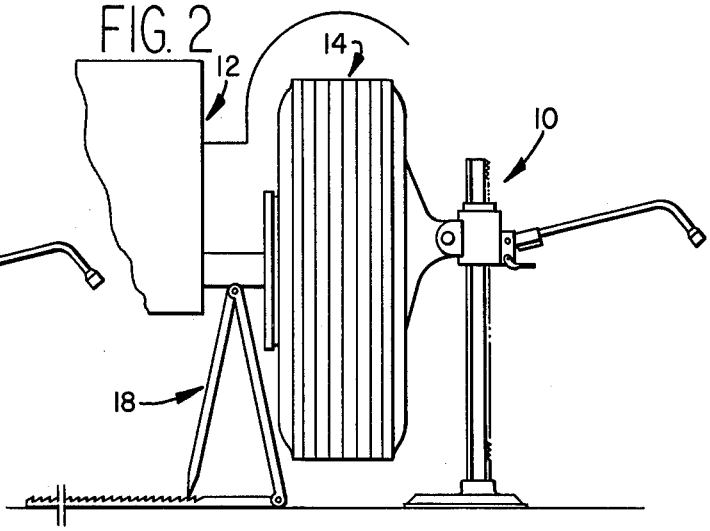
Figure 8:
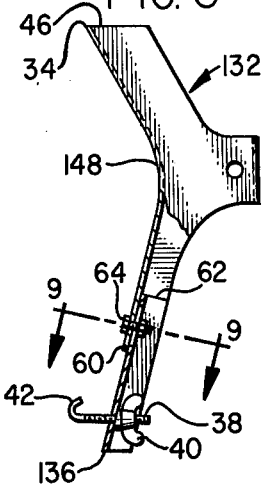
Figure 9:
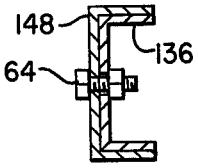
Figure 10:
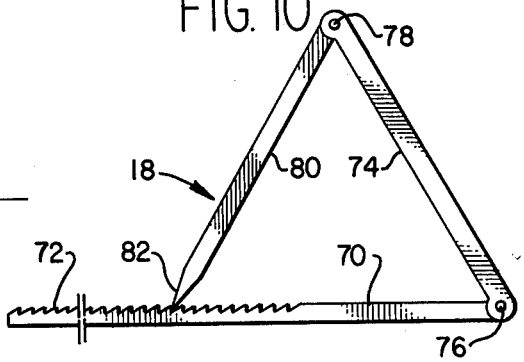
Figure 11:
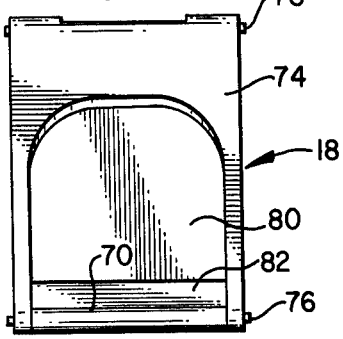

FIG, 8 is a partial side elevational view of a modification of part of the apparatus disclosed in the foregoing figures, with some parts being broken away therefrom and some of the remaining parts being shown in cross-section;

FIG. 9 is a cross-sectional view taken along lines 9—9 of FIG. 8;

FIG. 10 is an enlarged side elevational detail of part of the apparatus disclosed in FIG. 2; and, FIG. 11 is an end view of the apparatus disclosed in FIG. 10.

DETAIL DESCRIPTION OF THE PREFERRED EMBODIMENT

FIGS. 1–3 and 6 disclose a wheel jack apparatus 10 operatively associated with a vehicle 12. The vehicle has a pneumatic tire 14 mounted thereto. The tire includes the usual wheel 15 which has a bolt circle 16 which enables the wheel to be received in bolted relationship to hub 17. An adjustable stand 18 maintains the wheel and hub clear of the ground while one wheel and tire is being exchanged for another.

FIGS. 4–7 illustrate the details of the wheel jack apparatus. The jack apparatus has a platform 19 with a socket 20 formed centerally thereof for receiving a lower marginal end of a column or rack bar 22 in a removable manner therewithin, thereby providing a large bearing surface by which an appreciable amount of weight can be supported from a reasonably soft supporting surface. A plurality of lift detents or racks 24 are formed along the rear side of the vertical column. A lift mechanism in the form of a lifting head 26 cooperates with the column in a manner whereby handle 28 can be manipulated in the usual manner to cause the lift mechanism to move up or down the column. Trip lever 29 determines the direction of movement of the lift mechanism respective to the column.

Pivot pin 30 releasably engages a wheel lift adaptor 32. The adaptor includes a wheel engaging edge portion 34 at the upper outer end thereof and a fastener means at the lower end 36 thereof. The fastener means can take on several different forms and preferably is in the form of the illustrated J-bolt having a threaded end which receives a wing nut 40 thereon and a hook end 42 for engaging the rear of the wheel as will be pointed out in greater detail later on.

A plurality of apertures 44 enables the spaced apart distance between members 34 and 38 to be adjusted. The uppermost face of the adaptor at 46 can be sloped upwardly toward the front of the wheel or rearwardly toward the front of the jack, if desired. The front wall of the adaptor preferably is curved as noted at 48 with there being a concavity formed between the upper and lower extremes of the adaptor.

Figure 6:
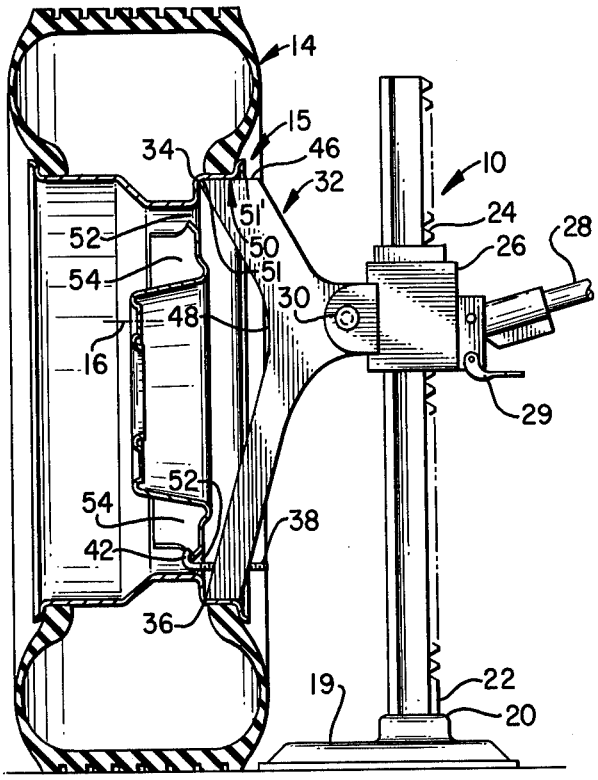
FIG. 6 is a part cross-sectional, side elevational view of the apparatus made in accordance with the present invention, shown in association with other structure.
Figure 7:
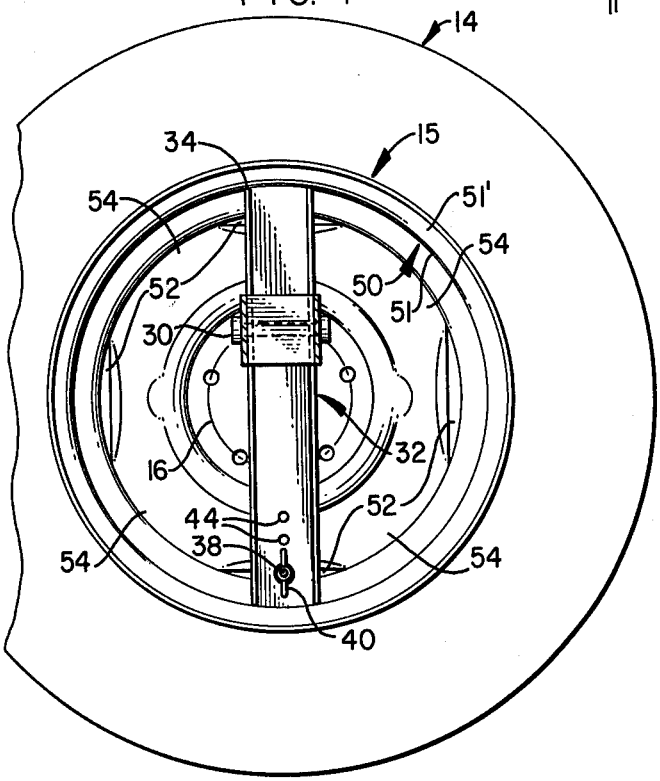
FIG. 7 is a rear view of part of the apparatus disclosed in FIG. 6.

As best seen in FIGS. 6 and 7, in conjunction with some of the remaining figures, the wheel 15 includes the usual circumferentially extending concavity 50 formed by the horizontal and vertical walls 51, 51'. The concavity 50 receives the circumferentially extending tire bead therewithin so that the tire can carry the load of the vehicle, and thereby forms a shoulder by which the wheel can be engaged and lifted according to this invention. Radially spaced apart slots 52 are formed between the lands or wheel spokes 54 with the spokes radiating from an inner or central portion which forms the before mentioned bolt circle and transfers the load from the hub into the wheel and thence into the tire at 50.

In the modification set forth in FIGS. 8 and 9, the lifting member 132 is seen to be comprised of a first member which terminates at 60 and a second member which terminates in an upper edge portion 62. The second member terminates at 136. Two coacting slots receive a bolt 64 therethrough so that the effective length measured between edge 34 and end 136 can be adjusted respective to one another, thereby enabling the lifting member to fit any number of different wheels.

As seen in FIGS. 10 and 11, the stand 18 preferably is made so that it can be folded into a compact package. The stand includes a base 70 having a plurality of lateral V-shaped grooves 72 formed therein. Upstanding support 74 is journaled at 76 to member 70. Journal 78 is formed between members 74 and 80. The adjustable end 82 of member 80 is selectively received within one of the grooves at 72, thereby enabling the effective height of the stand to be easily adjusted. The stand can be fitted to any suitable structure which is attached directly to the axle of the car.

In operation, the platform 19 is placed in proximity to the wheel to be changed. The column is fitted into the socket of the platform and the wheel lifting adaptor is attached to the lift mechanism after which the trip lever and handle are manipulated to bring the wheel engaging edge 34 of end 46 into engagement with the concavity formed at 50.

The fastener 38 is next inserted between the lands so that the hook portion 42 engages wheel structure thereby holding end 36 respective to the wheel while the edge 34 engages the concavity 50 to safely lift the wheel in a positive manner.

It will be noted that the radial distance measured between pivot 30 and edge portion 34 imparts a counter-clockwise turning moment into the member 32. Accordingly, fastener 38 must engage the wheel and provide a turning moment measured between pivot 30 and aperture 44 which is equal and opposite to the recited counter-clockwise moment.

Since the upper edge 46 supports the weight while the lower fastener 42 prevents turning of the wheel lift adapter, the lifting point of the assembly is located at pivot 30 rather than 50. This desirable expedient provides the unexpected result of preventing any lateral forces from forcing the vertical column into a leaning position. The lift point 30 can be moved further towards the handle, if desired, and can accordingly be located centrally of the lifting mechanism, or alternatively, at the rear of the lifting mechanism.

Should the lower fastener 42 be eliminated, the lift adaptor will turn counterclockwise until the lower end portion 36 thereof engages a medial length of the vertical column, thereby laterally urging the column towards a leaning position, which is undesirable and dangerous.

The platform 19 can be reversed respective to the vertical column so that a major area thereof is located on the outer side of the wheel jack. As another embodiment of this invention, a hydraulic jack mechanism can be used in order to lift the wheel adapter without departing from the scope of this invention. When a hydraulic jack mechanism is substituted for the vertical column and lift mechanism, the hydraulic cylinder preferably is used as the vertical column while the piston thereof is used as the lift mechanism. The wheel lift adapter can be readily fitted to the upper marginal end of the hydraulic jack piston extension so that enormous lifting forces can be attained with the hydraulic fluid pressure. This embodiment of the jack is especially useful in conjunction with large trucks and other heavy vehicles.

It will be appreciated that the elevation of pivot 30 above the ground is significantly shorter than the elevation measured on a conventional bumper jack when the wheel clears the ground. This is because the present invention need lift the vehicle from the ground only the amount necessary to compensate for the flat side of the tire.

Figure 3:
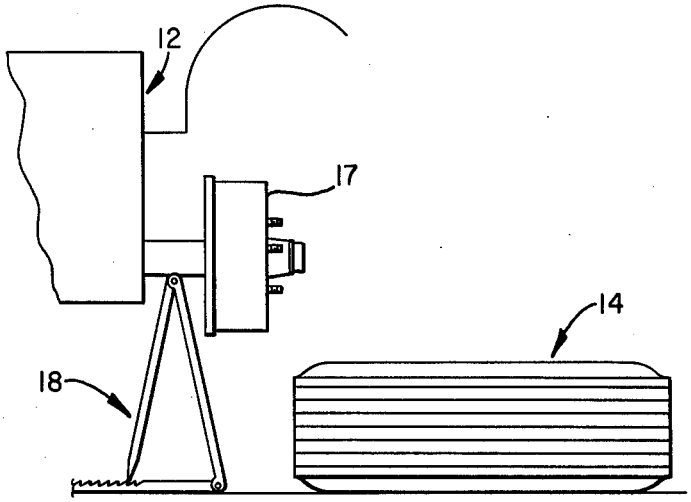
Figure 4:
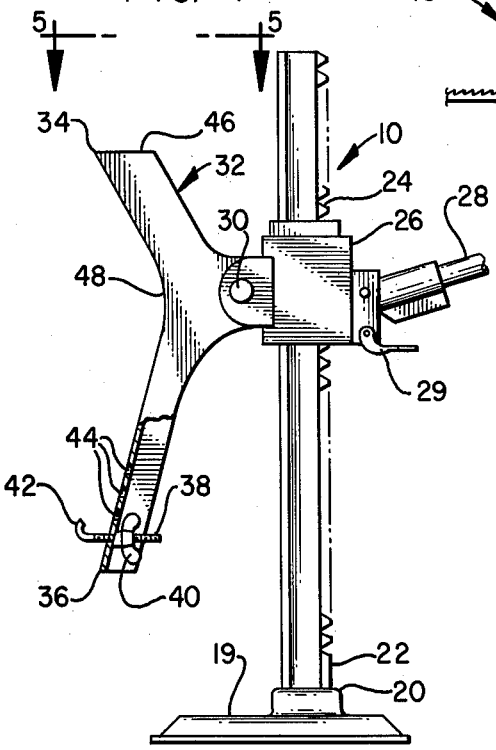
FIG. 4 is an enlarged, part cross-sectional, side elevational view of part of the apparatus illustrated in FIGS. 1–3.
Figure 5:
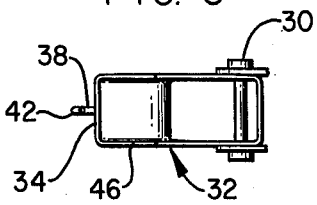
FIG. 5 is a top plan view taken along lines 5—5 of FIG. 4.

After the wheel has been jacked off the ground the stand apparatus disclosed in FIGS. 10 and 11 is placed under the vehicle in the illustrated manner of FIGS. 2 and 3 whereupon the lug nuts are removed from the hub and the wheel changed. After the wheel has been changed, the wheel jack is engaged with the wheel to facilitate removal of the stand apparatus.

I claim:

1. In combination with a vehicle supported by a plurality of wheels, each wheel having a circumferentially extending tire receiving rim spaced from a hub receiving bolt circle by a plurality of spokes, with the rim forming a circumferentially extending shoulder, a wheel jack for engaging and lifting the wheel along with a vehicle attached thereto;

said wheel jack includes a vertical column having a plurality of lift detents formed thereon, and a lifting mechanism which cooperates with said detents to cause the lifting mechanism to climb said column;

a wheel lift adaptor, means by which said adaptor is affixed to said lift mechanism; said adaptor having an upper end spaced forwardly and above and a lower end spaced forwardly and below the location where the adaptor is attached to the lift mechanism;

said upper end of said adaptor terminates in an edge portion which engages said shoulder; the marginal lower end of said adaptor has a fastener means formed thereon which extends through said spokes and engages wheel structure located in opposition to said shoulder.

2. The combination of claim 1 wherein said upper end of said adaptor is a plane which terminates in a sharp shoulder engaging edge portion.

3. The combination of claim 1 wherein said fastener means is a hook in the form of a J having one end affixed to said lower end of said adaptor with the hook end extending therefrom so that the hook end can be inserted through the spokes to engage the side of the wheel which is opposed to the wheel jack.

4. The combination of claim 1 wherein said upper end of said adaptor is an elongated plane which terminates in a sharp shoulder engaging edge portion;

said fastener means is a hook in the form of a J having one end affixed to said lower end of said adaptor and the hook end extending therefrom so that the hook end can be inserted through the spokes to engage the side of the wheel which is opposed to the wheel jack.

5. A wheel jack apparatus in combination with a wheel of a vehicle, wherein the wheel has spokes and a circumferentially extending shoulder formed about the spokes; said wheel jack includes a vertical column, a lifting mechanism including means by which said mechanism can be caused to climb said column;

a wheel adaptor having structure forming an upper, outer wheel engaging member, a lower end portion which includes a fastener means, and a rear portion;

means by which said rear portion is affixed to said lifting mechanism, said upper, outer wheel engaging member has an edge portion formed thereon which releasably engages the shoulder of the wheel; said fastener means can be extended through the spokes of the wheel and into engagement with wheel structure, while said edge portion of said upper, outer wheel engaging member engages the shoulder to thereby enable the wheel along with a vehicle to be lifted when the lifting mechanism climbs the column.

6. The wheel jack of claim 5 wherein said upper end of said adaptor is a plane which presents a sharp shoulder engaging edge portion.

7. The wheel jack of claim 5 wherein said fastener means is a hook in the form of a J having one end affixed to said lower end of said adaptor and the hook end extending therefrom so that the hook end can be inserted through the spokes of a wheel to engage the rear of the wheel which is opposed to the wheel jack.

8. The wheel jack of claim 5 wherein said upper end of said adaptor is in the form of a sharp rim engaging edge portion;

said fastener means is a hook in the form of a J having one end affixed to said lower end of said adaptor and the hook end extending therefrom so that the hook end can be inserted through the spokes of a wheel to engage structure located at the rear of the wheel which is opposed to the wheel jack.

9. The wheel jack of claim 5 wherein said wheel adaptor has a curved front, said rear portion is pivoted to said lift mechanism, the distance from said pivot to said edge is greater than the distance from said pivot to said fastener.

* * * * *